US005693905A

United States Patent [19]

Blodgett et al.

[11] Patent Number: 5,693,905

[45] Date of Patent: Dec. 2, 1997

[54] PRIMER LOADING TOOL

[75] Inventors: Fred B. Blodgett, Chico; Jerry D. Brand, Oroville; Donald F. Legg, Jr., Oroville; Arthur F. Peters, Oroville; Lester V. Rodriques, Oroville; Steven R. Shields, Oroville, all of Calif.

[73] Assignee: Blount, Inc., Montgomer, Ala.

[21] Appl. No.: 710,317

[22] Filed: Sep. 16, 1996

[51] Int. Cl.[6] ..... F42B 33/04; F42B 33/10

[52] U.S. Cl. ..... 86/32; 86/36; 86/23

[58] Field of Search ..... 86/32, 33, 36, 86/37, 38, 23, 24

[56] References Cited

U.S. PATENT DOCUMENTS

| | | | |
|---|---|---|---|
| 3,224,318 | 12/1965 | Bachhuber | 86/38 |
| 3,349,663 | 10/1967 | Slee | 86/38 |
| 3,973,465 | 8/1976 | Bachhuber et al. | 86/36 |
| 4,429,610 | 2/1984 | Mantel | 86/36 |
| 4,841,831 | 6/1989 | Bender et al. . | |
| 5,198,606 | 3/1993 | Storstad et al. . | |
| 5,435,223 | 7/1995 | Blodgett et al. . | |

*Primary Examiner*—Michael J. Carone
*Assistant Examiner*—Theresa M. Wesson
*Attorney, Agent, or Firm*—Klarquist Sparkman Campbell Leigh & Whinston, LLP

[57] ABSTRACT

A device for loading a primer from a priming station into a primer socket of an ammunition cartridge case, includes an elongated track for longitudinally guiding a rectilinear primer strip through the priming station. The primer strip includes a series of longitudinally aligned receptacles, each of which holds a primer in an interference fit that prevents dislodgement of the primer from the strip. Each primer strip also has a plurality of laterally extending castellations or teeth that slide on a ledge over the track, and a reciprocating advancing member on the track has arms that interdigitate with the teeth to move the primer strip forward through the priming station as the advancing member moves in an advancing direction. A detent interdigitates with the teeth to hold the primer strip with a target receptacle in a target position adjacent the primer socket of the cartridge case, while a reciprocating punch pin transfers the primer from the target receptacle to the primer socket. The primer strips provide a compact storage member that safely and conveniently allows primers to be loaded into spent ammunition cartridges.

39 Claims, 7 Drawing Sheets

FIG. 7
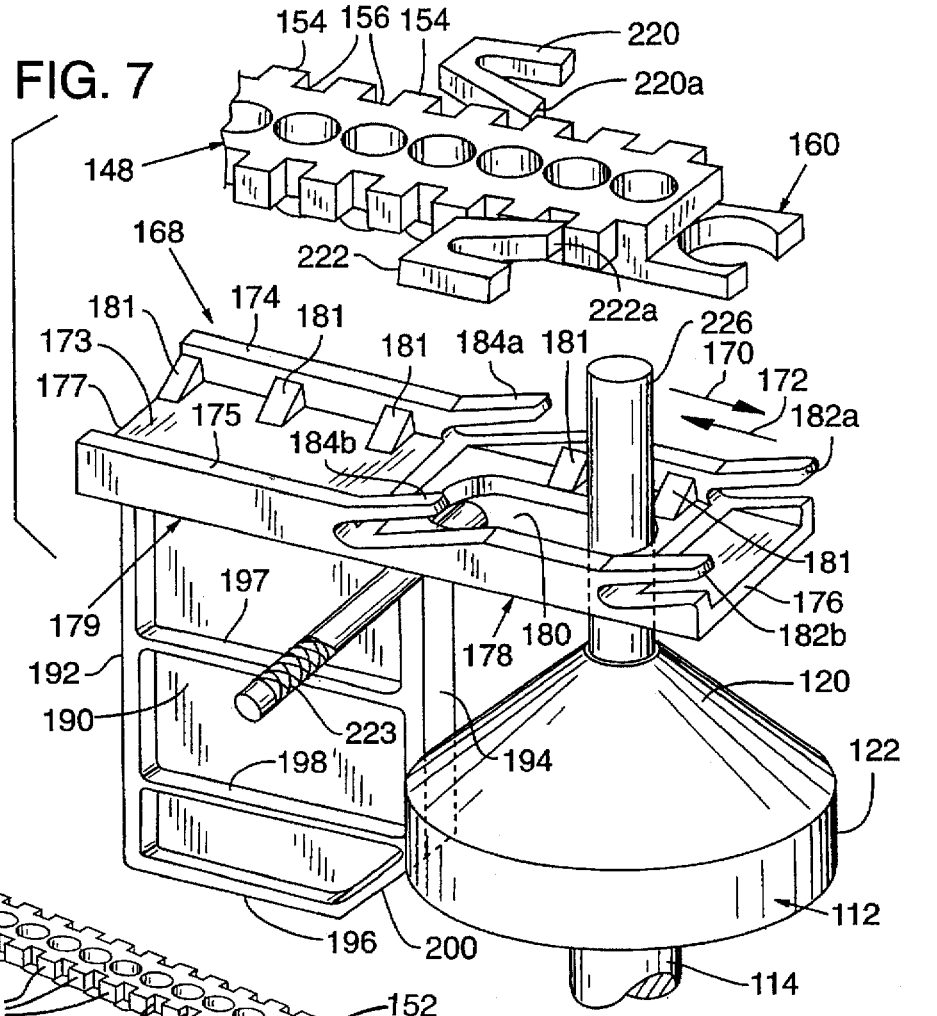
FIG. 9
FIG. 8
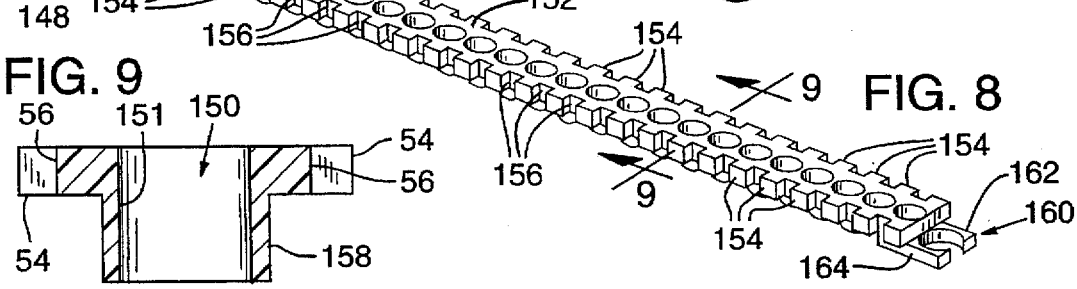
FIG. 10
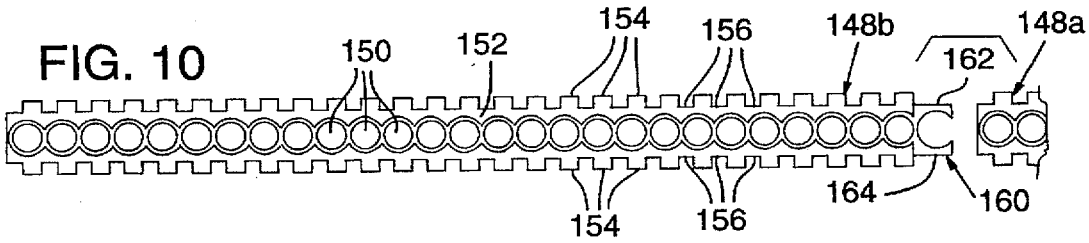

PRIMER LOADING TOOL

FIELD OF THE INVENTION

This invention relates generally to ammunition reloading systems, and more specifically to a system for safely and conveniently loading primers into ammunition cartridge cases.

BACKGROUND OF THE INVENTION

Ammunition for a small firearm typically includes a bullet projectile seated within a cartridge case. The case is a hollow cylinder with an open end sized to tightly hold the trailing edge of the bullet, and a socket end that receives a primer which contains a small amount of combustible material. When a firearm is discharged, a firing pin of a hammer strikes the exposed end of the primer in the shell, forcing an anvil in the primer to compress and ignite the combustible material in the primer socket.

The combustible material in the primer socket undergoes a fast, controlled burn which in turn ignites gunpowder inside the cartridge case via a flash hole, to propel the bullet out of the case toward a target. Although the bullet may be deformed by striking its target, the cartridge case remains intact after firing, with the spent primer wedged in the end of the case. The case may then be discarded or reused.

Many firearm enthusiasts reload their own ammunition to reduce costs, control the quality of the reloading, and to have the ability to customize the ammunition. The ability to reload the cartridge cases is particularly important to gun enthusiasts and military or law enforcement personnel, who may fire numerous rounds during practice sessions. Reloading involves several steps, including removing the spent primer, reforming the casing to a desired shape and size, and inserting a new primer into the empty primer socket. Devices have been developed in the past to perform all these functions, either sequentially or simultaneously on multiple casings.

U.S. Pat. No. 5,198,606, for example, discloses an apparatus that removes the spent primer, and pushes a replacement primer out of a disk shaped holder to transfer the primer to the primer socket. The primers are in chambers aligned peripherally around an edge of the disk, and the disk is incrementally rotated to sequentially align target receptacles with a pusher pin that transfers the primer from the target receptacle to the primer socket.

The disk shaped primer holder of the '606 patent provides a rigid structure that retains the primers in an interference fit to minimize handling of the primers, and improve safety of the priming operation. This disk must be removed and replaced when empty, however, which can impair the efficiency and speed of the priming operation. It is also difficult to determine from the position of the disk how many of the primers have been unloaded because the disk is symmetric about its center of rotation. The disk also inherently requires unused space toward the center of the disk, that is unavailable for storing primers.

It is accordingly an object of this invention to provide an improved device for re-priming spent ammunition casings that does not require interruption of the priming process to change a disk.

Another object of the invention is to provide such a device having a shape that indicates the proportion of unspent primers remaining in the primer holder.

Yet another object is to provide such a device that more efficiently fills the available space in the holder.

Finally, it is an object of the invention to provide such a device that simply and efficiently reloads primers into spent cartridge cases.

SUMMARY OF THE INVENTION

The foregoing objects are achieved by providing a tool for inserting a primer into an ammunition cartridge case having a primer socket. The tool includes a priming station having a holder that holds the cartridge case with the primer socket in a loading position. An elongated primer holder strip contains a plurality of longitudinally aligned primer receptacles that each holds a primer in an interference fit. An advancer incrementally longitudinally advances the elongated primer strip through the priming station to bring sequential receptacles into a target position in the priming station. A punch member aligned with the receptacle in the target position then punches the primer out of the target receptacle and transfers the primer into the primer socket occupying the adjacent loading position.

The punch member preferably includes a reciprocating pin carried by the punch member that moves into and through the target receptacle to transfer the primer from the target receptacle to the primer socket. In a disclosed embodiment, the advancer incrementally linearly advances the primer holder strip to align subsequent primers in subsequent target receptacles with a target position from which the primer is transferred to a primer socket. The advancer is activated by moving a hand operated lever that reciprocates a sliding advancement member in a straight line along a straight track. Arms from the advancement member engage lateral projections along edges of the primer strip to incrementally move the strip in an advancing direction.

In a more detailed embodiment, the primer device comprises a priming station having a holder for holding the cartridge case in a loading position with a primer socket of the cartridge case facing the priming station. An elongated rectilinear track extends through the priming station, for guiding an elongated rectilinear primer strip having a plurality of longitudinally aligned primer containing receptacles. The strip is provided with a series of equally spaced teeth or castellations extending laterally from both longitudinal edges of the strip. The teeth have a fixed position relative to the receptacles, so that the position of the teeth can be used to position the receptacles in a desired location. A reciprocating punch member is advanceable toward the priming station to introduce a punch pin through the primer station into the primer socket, and retractable away from the priming station to retract the punch pin out of the primer socket.

An indexing mechanism advances the primer strip longitudinally along a path of movement on the track after loading one of the primers from the priming station into the cartridge case. The indexing mechanism includes a sliding member on the track that reciprocates between an advancing direction along the path of movement and a retracting direction opposite the advancing direction. An arm projects from the sliding member in the advancing direction to engage the teeth projecting laterally from the priming member, and incrementally push the strip in the advancing direction as the sliding member reciprocates in the advancing direction. A detent engages the lateral projections on the primer strip, and allows the strip to move with the sliding member in the advancing direction, but opposes movement of the primer strip as the sliding member moves in the retracting direction.

The primer device may be connected to a conventional bench-mounted press having a hand-operated lever, or incorporated into a dedicated base having a lever, for reciprocating a ram along an axis of movement through the target receptacle on the primer strip. Advancement of the ram introduces a push pin through the primer strip receptacle and into an empty case socket to push the primer out of the strip receptacle and into the case socket. Advancement of the ram also pushes against the sliding member to move the sliding member in the retracting direction, while the strip is held stationary by the detent, to align the arm of the sliding member behind a subsequent set of teeth. Retraction of the ram withdraws the punch pin from the primer receptacle and allows the sliding member to move in the advancing direction, which incrementally advances the primer strip to align a primer in a subsequent receptacle with the punch pin. A new cartridge case (having an empty socket) is then placed in the loading position. Repeated reciprocation of the ram incrementally advances the strip and transfers sequential primers into sequential cartridge case sockets.

A better understanding of the invention can be had by reference to the following drawings and detailed description.

BRIEF DESCRIPTION OF THE DRAWINGS

FIG. 7 is an enlarged, exploded, perspective view of the advancement mechanism and detent, a portion of the ram being shown in its extended position with the punch pin extending through a slot in the advancement mechanism.

FIG. 8 is an isolated perspective view of a primer strip for use in the device of the present invention.

FIG. 9 is an enlarged cross-sectional view of the primer strip taken along section line 9—9 of FIG. 8.

FIG. 10 is a top view of the primer strip shown in FIG. 8, with an adjacent primer strip shown in position for end to end attachment to the first primer strip.

DETAILED DESCRIPTION OF PREFERRED EMBODIMENTS

Figures 1, 1A:
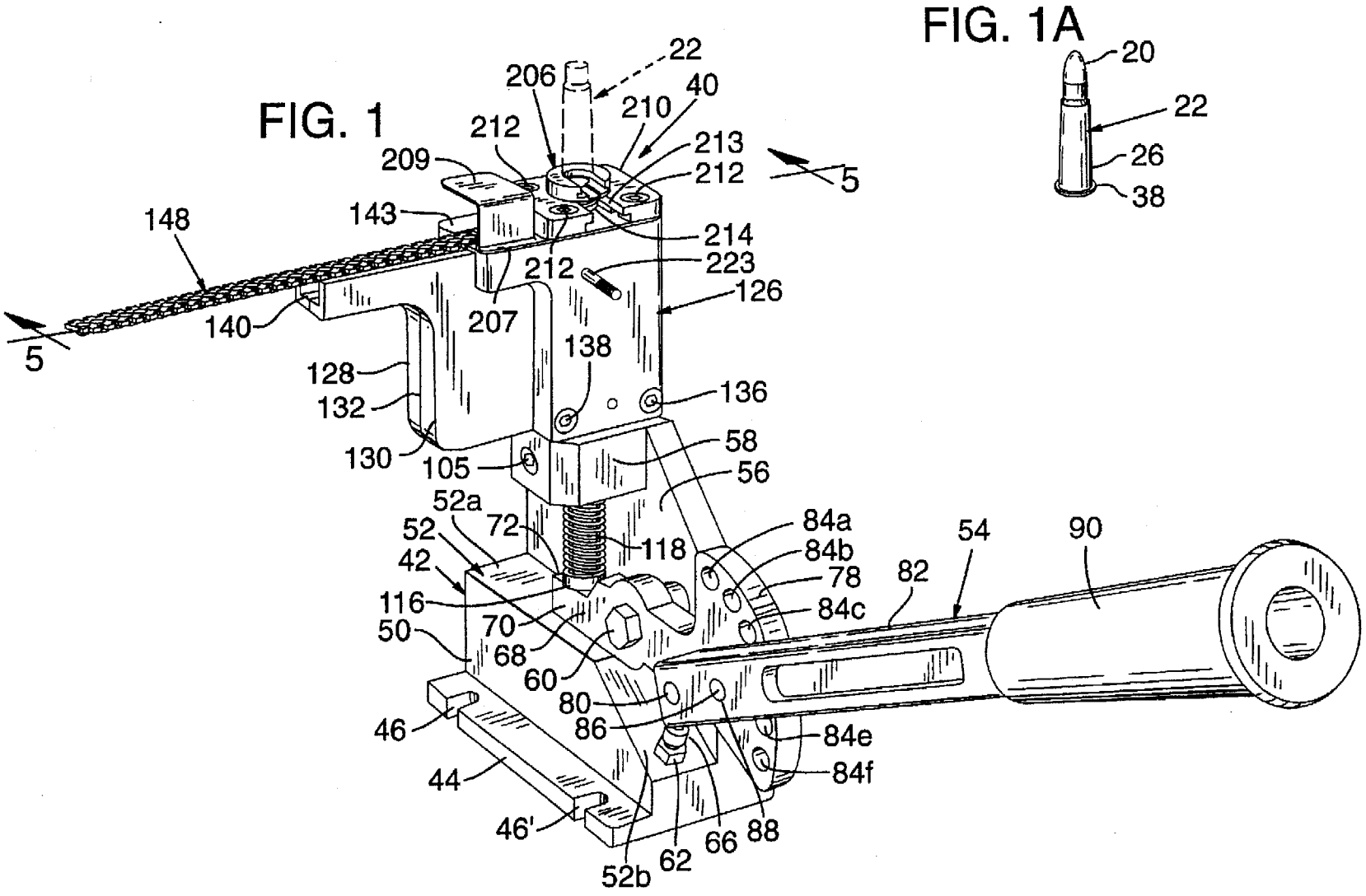
FIG. 1 is a perspective view of the assembled apparatus for inserting a primer into a cartridge case, showing the primer strip feeding into the priming station.
FIG. 1A is an isolated view of a cartridge case with the bullet in the case.
Figures 2, 3:
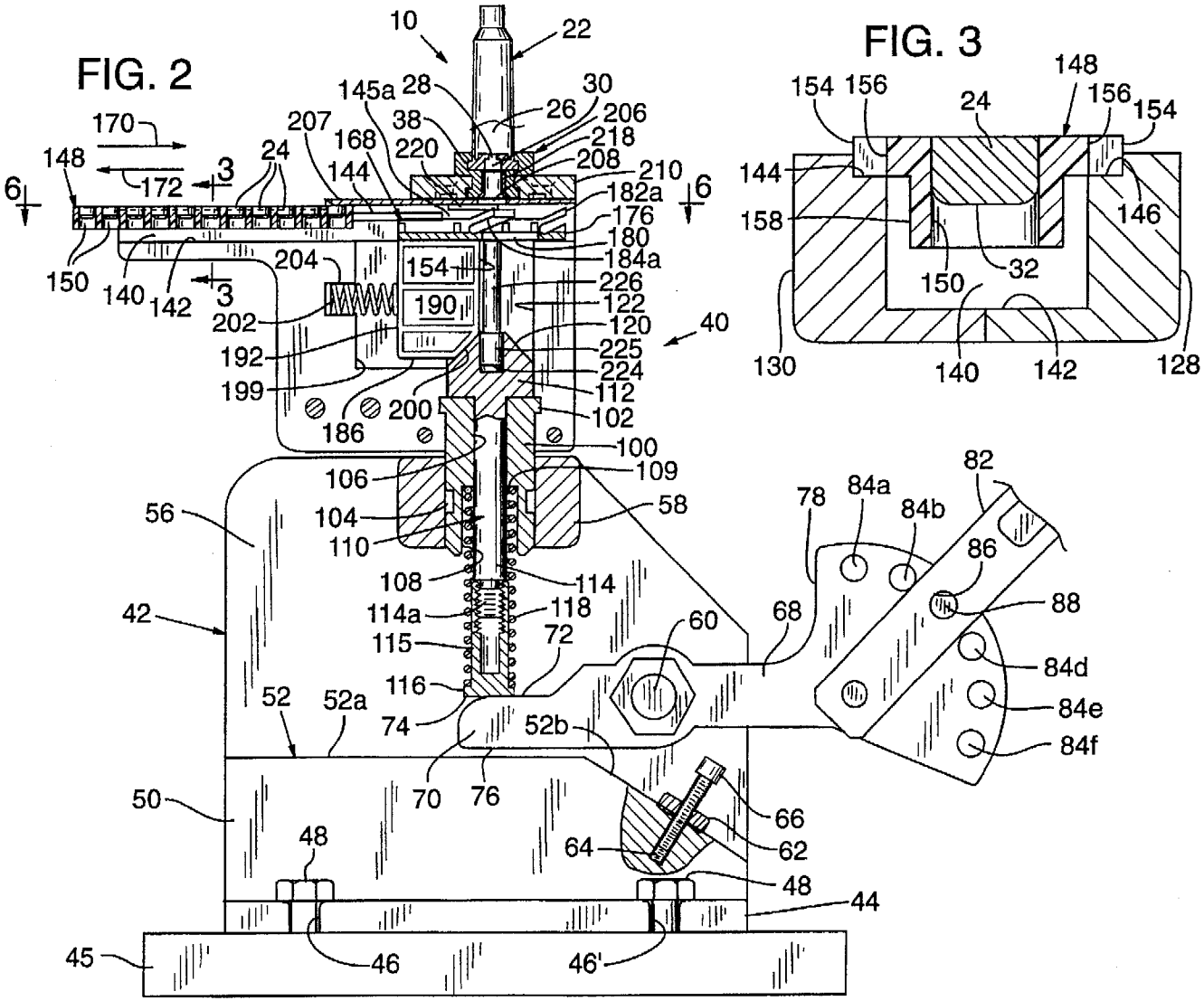
FIG. 2 is an enlarged side view, partially in cross-section, of the apparatus shown in FIG. 1.
FIG. 3 is an enlarged view, taken along lines 3—3 in FIG. 2, of the primer strip in its guide track.
Figure 4:
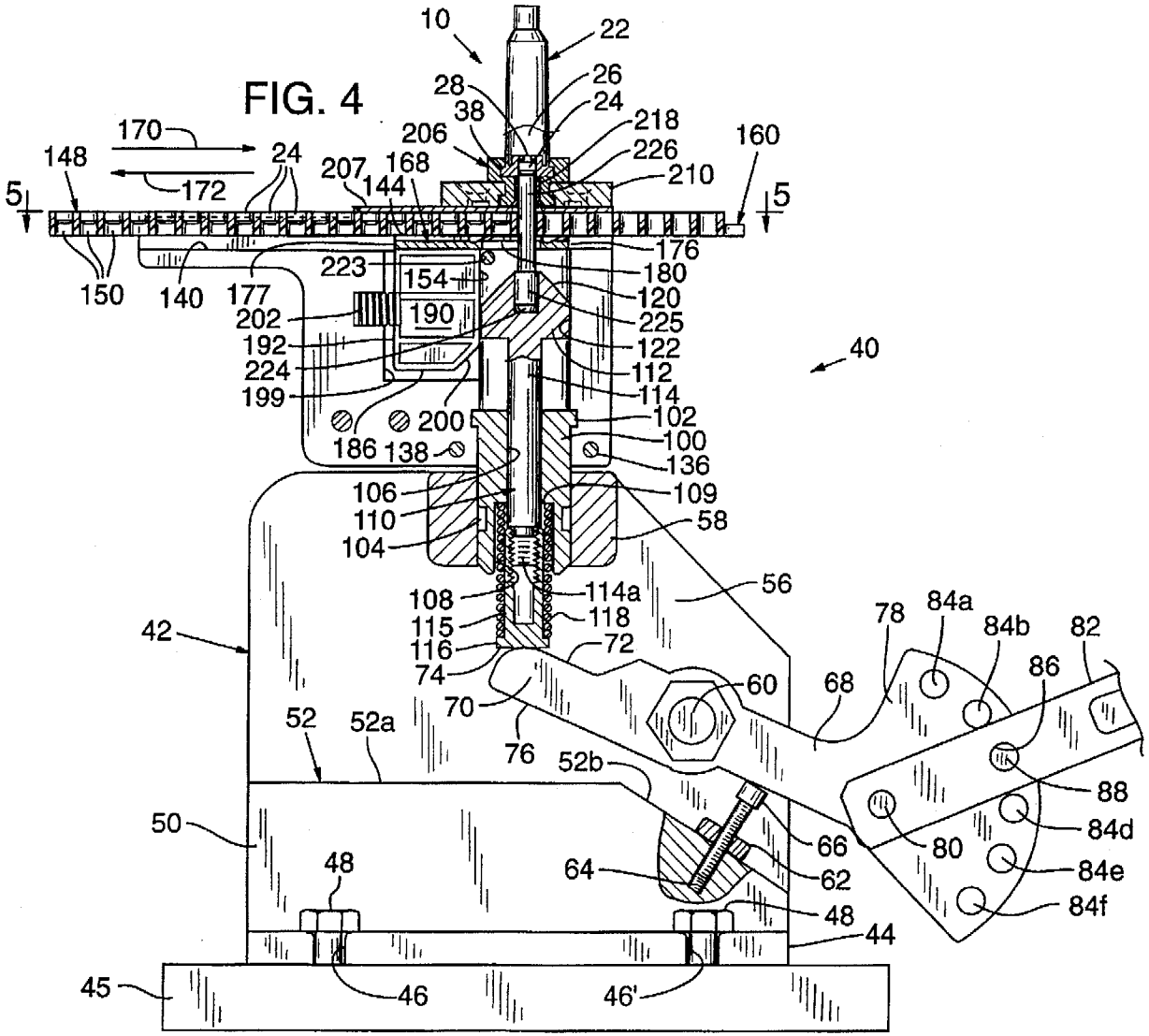
FIG. 4 is a view of the apparatus shown in FIG. 2, but with the primer strip extending through the priming station, and an operating handle depressed to advance a punch pin through a receptacle of the primer strip.

An ammunition cartridge for a firearm (such as a pistol or rifle) is shown in FIGS. 1, 2 and 4. The assembled cartridge includes a bullet 20 (shown only in FIG. 1A), which is a projectile that is seated within a cartridge case 22 that includes a primer 24. Although the bullet is shown in FIG. 1A for purposes of illustration, it should be understood that the bullet is not normally present during the stage of loading the primer into the cartridge case.

The case 22 is a hollow cylinder with an open end sized to hold the trailing end of the bullet 20 in a press fit. Gun powder 26, or a similar propellant, is provided in a powder chamber within case 22. A small flash hole 28 in the center of the closed, or head, end of the cartridge case establishes communication between the powder chamber and a primer pocket or socket 30 (FIG. 2). The primer 24 includes a metal cup, which is a small receptacle partially filled with a combustible composition. An anvil (not shown) of primer 24 encloses the combustible composition within primer 24.

During assembly, primer 24 is forced into socket 30 in case 22 so that the bottom of the metal cup is flush, or slightly depressed relative to, the closed end of the case 22, as in FIG. 4. The closed end of case 22 includes a rigid base with a peripheral flange 38 around primer socket 30. The flange 38 provides a structure that can be held to immobilize the shell with the primer socket in a loading position during loading of primer 24 into primer socket 30.

When a firearm is discharged, a firing pin or hammer strikes the exposed end of the primer in the shell, igniting the combustible composition therein. The primer composition undergoes a fast, controlled burn which in turn ignites the gunpowder propellant 26 via flash hole 28. Combustion of gunpowder 26 produces expanding gases that propel bullet 20 (FIG. 1A) out of case 22 toward a target. Although bullet 20 may be deformed by striking its target, the cartridge case remains intact after firing, with the spent primer wedged in the end of case 22. The case 22 may then be discarded, or re-loaded by placing a new primer in the case.

According to the present invention, a first embodiment of a device 40 for loading a primer 24 into a primer socket of an ammunition cartridge case is shown in FIGS. 1–7 and 11. As shown best in FIGS. 1–2 and 4, device 40 includes a heavy metal base 42 with a horizontal flat bottom plate 44 that can rest on a work surface, such as a work bench, a portion of which is shown at 45. Plate 44 is a thin, generally rectangular metal plate that has two sets of complementary opposing edge slots 46 through which bolts 48 can be placed to secure base 42 to the work surface.

An intermediate support member 50, which is narrower than plate 44, extends upwardly from plate 44 along the length of the plate to provide an elevated support surface 52 for a manual operating lever 54. A vertical support plate 56 extends upwardly from member 50. A horizontal support collar 58 extends laterally from plate 56 and is cantilevered above surface 52. Support surface 52 has a generally horizontal portion **52*a* and a downwardly inclined portion 52*b*. A horizontal pivot pin 60 extends through plate 56 above inclined surface 52*b*. An externally threaded adjustment screw 66 extends through a nut 62, upwardly normal to inclined surface 52*b* to limit an arc of movement of the operating lever 54, as described below. Adjustment screw 66 rotates in an internally threaded bore 64 (FIGS. 2 and 4) to adjust the height of screw head 66 above inclined surface 52*b***.

As shown in FIG. 1, operating lever 54 includes a pivot arm 68 that has an intermediate section that is pivotally secured to pivot pin 60, for rotation about pivot pin 60 in a vertical plane. A support tip 70 of arm 68 extends over surface **52*a*, and includes a top bearing surface 72 (best illustrated in FIGS. 2 and 4) which bears against a flat bottom bearing surface 74 of reciprocal ram 110. A bottom support surface 76 of arm 68 extends parallel to surface 52***a* of the support member 52 when arm 68 is in the position shown in FIG. 2. On the other side of pivot pin 60, arm 68 has an enlarged connection head 78 in the form of a vertical plate having the shape of a 120 degree portion of a circle. A central connection bore though the head 78 receives a connection pin 80 that extends through a complementary bore in one end portion of an elongated handle 82.

A series of equally spaced handle adjustment bores 84*a*, 84*b*, 84*c*, 84*d*, 84*e* and 84*f* are arranged circumferentially adjacent the curved edge of connection head 78. A corresponding, complementary adjustment bore 86 through handle 82 accepts an adjustment pin 88 that extends through bore 86 and one of the bores 84*a*–84*f* to secure handle 82 to head 78 of pivot arm 68. The angle at which handle 82 extends from pivot arm 68 is determined by which of the bores 84*a*–84*f* is selected for placement of the adjustment pin 88. In FIGS. 2 and 4, pin 8 extends through orifice 84*c*. A plastic tubular grip 90 is provided at the free end of handle 82 with which to grasp the handle to depress it and load the primer as described herein.

Figure 11:
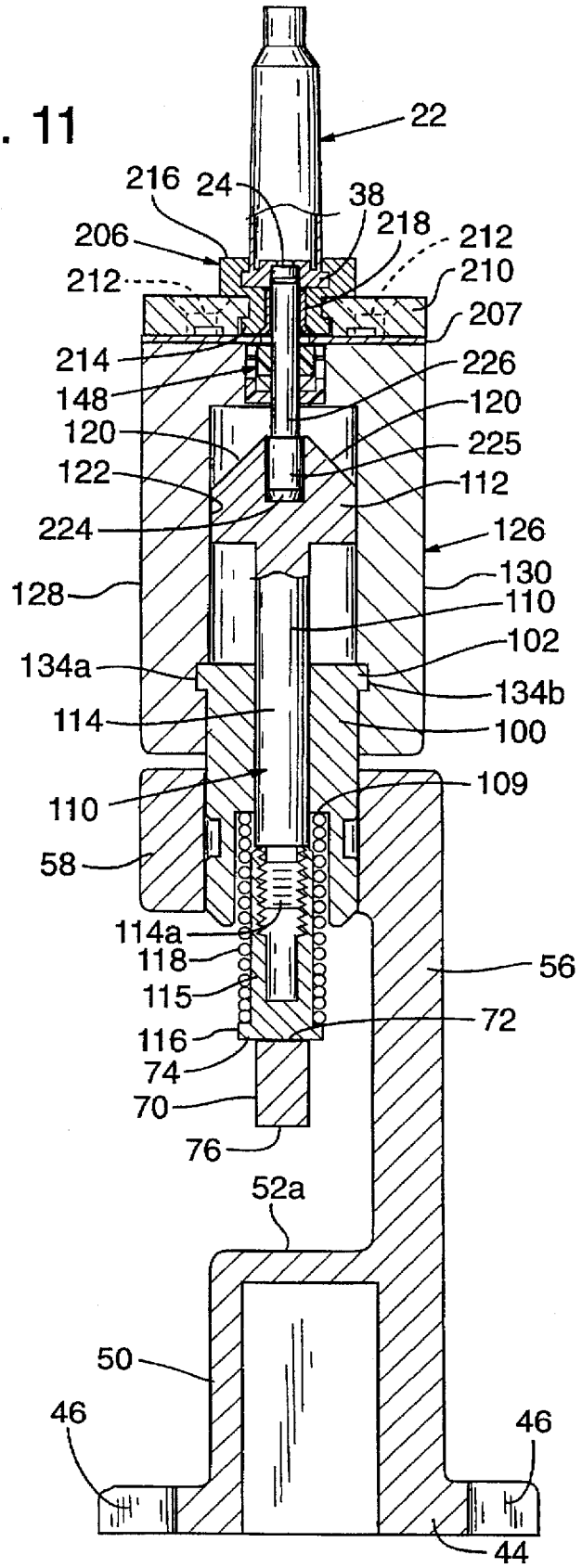
FIG. 11 is an enlarged cross-sectional view taken along line 11—11 of FIG. 2.

The ram 110 that is reciprocated by pivot arm 68 is best illustrated in FIGS. 2, 4 and 11. The ram moves in a stationary tubular sleeve 100 having a peripheral upper flange 102 and an intermediate groove 104. The lower portion of sleeve 100 is externally threaded, and mates with internal threads in collar 58 to maintain sleeve 100 in a fixed position relative to collar 58. A set screw 105 (FIG. 1) through collar 58 seats in groove 104 (FIG. 2) to further lock sleeve 100 in place within collar 58.

Sleeve 100 defines a central tubular passageway, that has a smaller diameter upper portion 106 and an enlarged diameter lower portion 108 which are joined by an annular shoulder 109. The reciprocal ram 110 slides vertically within sleeve 100, and has an enlarged head 112 that is wider than the upper portion 106 of the tubular passageway. The ram 110 also includes a necked down shaft 114 having a constant outer diameter which is only slightly less than the diameter of upper portion 106 of the tubular passageway through the sleeve 100, to guide ram 110 in smooth reciprocating movement within sleeve 100. An externally threaded tip 114*a* of shaft 114 mates in threaded engagement with an internally threaded tubular end 115, so that the length of ram 110 can be adjusted by rotating end 115 relative to tip 114*a*.

A lower peripheral flange forms a rim 116 around bearing surface 74 at the bottom of end 115. A compression spring 118 seats on rim 116 and extends between rim 116 and internal shoulder 109 to bias ram 110 downwardly away from the extended position shown in FIG. 4, toward the retracted position shown in FIG. 2. Head 112 of ram 110 is frustoconical, having an annular inclined bearing shoulder 120 that presents a smooth annular surface, and a cylindrical side wall face 122 (FIG. 7).

Figure 5:
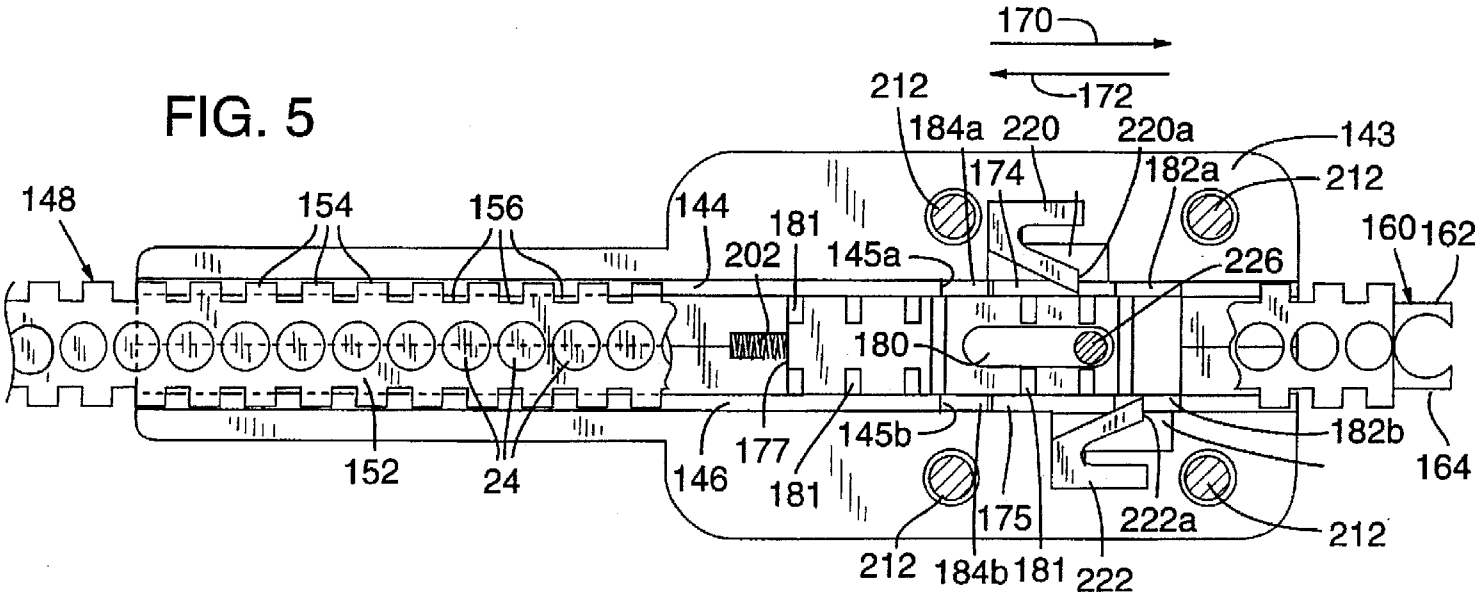
FIG. 5 is a view taken along line 5—5 in FIG. 4, portions of the primer strip being broken away to reveal the advancement mechanism in its retracted position.
Figure 6:
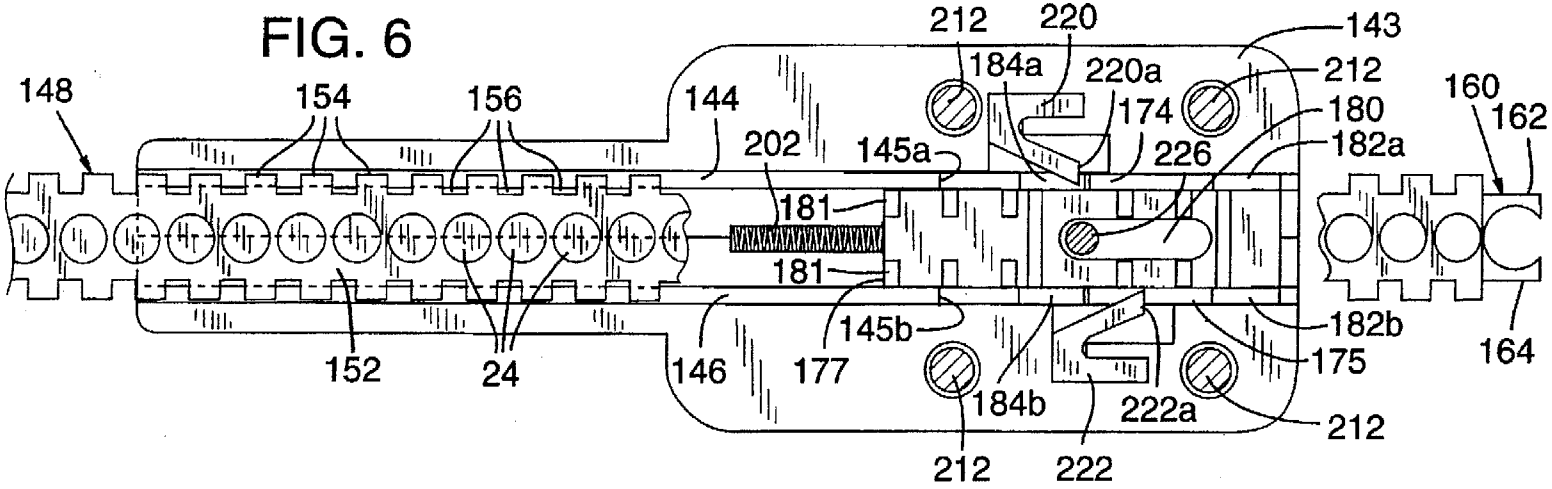
FIG. 6 is a view similar to FIG. 5, but with the advancement mechanism shown in its advanced position, and the push pin retracted.

A priming head 126 of the device 40 is shown in FIGS. 1–2, 4 and 11 to include a pair of opposing, mirror image body members 128, 130 which meet along a mating edge 132, and are held in engagement by a plurality of screws 136, 138 extending between the mating body members. The inner faces of members 128, 130 are provided with complementary opposing horizontal grooves 134*a*, 134*b* (FIG. 11) in which flange 102 of sleeve 100 seats to maintain the priming head 126 in a desired relationship to the base 42 and ram 110. As best shown in FIG. 3, the opposing body members cooperatively form a linearly extending, rectilinear elongated track 140 that has a flat lower surface 142. A pair of opposing, parallel ledges 144, 146 (FIGS. 3, 5 and 6) extend longitudinally along track 140, spaced above and parallel to lower surface 142. The ledges are continuous, except for an interrupted section 145*a*, 145*b* (FIGS. 1, 5 and 6). A top surface 143 of body members 128, 130 forms a wide surface area around a priming station where a primer 24 is loaded into the cartridge case 22. Surface 143 is slightly spaced above ledges 144, 146, for example by a distance of about 1 mm (which is approximately the depth of primer strip teeth that slide along ledges 144, 146).

Track 140 is designed to support a generally rectilinear primer strip 148 (best illustrated in FIGS. 5–10) having a plurality of primer containing receptacles 150, each of which carries a conventional primer 24 (FIG. 3) having a bottom 32. FIGS. 8–10 show a preferred embodiment of the strip 148, which is preferably a molded polymeric part, for example a resinous plastic material. A suitable material for the strip is polypropylene, but other resilient polymeric materials may also be used. In the disclosed embodiment, the strip is long and narrow (for example, 12 cm long and 12 mm wide), and shallow (about 4 to 5 mm deep).

Strip 148 includes a substantially planar portion 152 (FIG. 8) that provides a basic frame having opposing longitudinal edges, from which project a series of longitudinally spaced lateral projections in the form of identical castellations or teeth 154 that extend in the plane of portion 152. An axis of symmetry runs along the longitudinal axis of the strip, such that each half of the strip (including the castellations) are the mirror image of the other half. The teeth 154 form a series of gaps 156 that provide a means of indexing the strip 148 as the strip progresses along the track.

Each receptacle 150 is a substantially tubular member formed by an orifice 151 (FIG. 9) in the strip, and a substantially tubular extension 158 depending from the planar portion. The tubular portions of the receptacles form a bas relief lower portion of the strip. Each receptacle 150 holds a corresponding primer 24 in a tight, interference fit such that the primer is not easily dislodged from the receptacle during transportation, or at any time before it is desired to load the primer into the cartridge case primer socket. The interior walls of each receptacle have flattened areas to improve the interference fit between the primer 24 and receptacle 150.

Receptacles 150 are of substantially equal radius (for example, 2.5 mm), which is slightly less than the radius of the primer 24, and the receptacles are substantially equally spaced along the length of strip 148, in overlapping tangential relationship. The width of each tooth 154 is about one-half the distance between the centers of each tubular receptacle 150, and the width of each gap 156 is also about one-half the distance between the centers of each receptacle 150. The teeth are also provided in a fixed location with respect to each receptacle 150, such that the position of the tooth predictably locates its associated receptacle in a desired target location. There is very little wasted space in the strip, because the receptacles occupy the majority of the volume of the strip.

A hook 160 (FIG. 10) extends longitudinally from one transverse edge of the strip 148 in the plane of the tubular extensions 158. Hook 160 includes opposing, complementary arms 162, 164 that form a portion of a tubular extension 158. In the disclosed embodiment, arms 162, 164 form over one-half of a tubular extension, without any overlying planar portion 152. The tubular extension of a receptacle at the end of a first strip 148*a* (FIG. 10) can be placed within the arms 162, 164 of a second strip 148*b*, such that second strip 148*b* will be dragged along behind first strip 148*a* in the same direction that strip 148*a* is advanced longitudinally along track 140.

Strip 148 is advanced longitudinally along track 140 by an advancement member 168 (see FIG. 7) that reciprocally slides along track 140 in an advancing direction 170 and a retracting direction 172 (see arrows in FIGS. 5 and 7). Advancement member 168 is shown in FIG. 7 to include a rectangular, substantially flat base 173 having longitudinal ridges 174, 175, a leading edge 176, and a trailing edge 177. Member 168 includes a rectangular forward section 178 and a rectangular rear section 179, with an elongated, longitudinally extending slot 180 extending through forward section 178, generally perpendicular to edges 176, 177. Several structural brace members 181 are positioned at the intersection of base 173 and ridges 174 or 175.

A forward pair of parallel advancement arms **182*a* and 182*b* incline upwardly from the ridges 174, 175 along the longitudinal edges of advancement members 168, while a pair of rear advancement arms 184*a*, 184*b* also incline upwardly from a longitudinal edge of advancement member 168. The arms 182, 184 are inclined upwardly in the advancing direction 170. Forward arms 182*a*, 182*b* extend from the front edge of slot 180 to leading edge 176 of advancement member 168. Rear arms 184*a*, 184*b* extend from rearwardly of slot 180 (at the intersection of forward and rear sections 178, 179) to a position near the trailing end of slot 180. Each of the arms is inclined at an angle of about 30 degrees to the surface of base 130, and are of equal length. The length of the arms is sufficient to extend above side ridges 174, 175 along the edges of advancement member 168**.

Rear portion 173 of the advancement member includes a depending, elongated pusher plate 190 that extends perpendicularly down from base 173. Pusher plate 190 includes parallel upright side ribs 192, 194, a bottom rib 196, internal support ribs 197, 198 extending between side ribs 192, 194, and an angled rib between ridges 194, 196 that forms an inclined bearing surface 200. The advancement member is supported by and slides on track 140 for reciprocating movement in the advancing and retracting directions 170, 172. The range of reciprocation of advancement member 168 in the retracting direction is limited by an internal wall 198 within body members 128, 130. Reciprocation in the advancement direction is limited by ram head 112.

As shown in FIG. 2, pusher plate 190 (and its associated advancement member 168) is biased in the advancing direction 170 by a compression spring 202 that extends between a spring seat 204 in wall 199 and side rib 192 of pusher plate 190. When biased into the advanced position shown in FIG. 2, inclined bearing surface 200 of plate 190 seats against the annular inclined bearing shoulder 120 of retracted ram head 112. The slope of smooth bearing surfaces 120, 200 are the same, such that advancement of ram 110 upwardly against the bias of its compression spring 118 by operation of pivot arm 68 smoothly slides head 112 along bearing surface 200 to force push plate 190 in the retracting direction 172, to the retracted position shown in FIG. 4. In this position, the annular side face 122 of head 112 abuts against side rib 194 to maintain push plate 190 in the retracted position.

A priming station is provided on device 40 in which primers are sequentially transferred from the primer strip 148 to cartridge cases 22. A holder 206 (FIG. 1) sits over the priming station, and includes a protection plate 207 with a punch hole 208 (FIG. 2) aligned with an axis of advancement of ram 110. An L-shaped blast shield plate 209 (FIG. 1) extends up from plate 207 and over track 140. A spacer cap 210 (FIGS. 2 and 11) is secured to plate 207 by a plurality of threaded screws 212. Cap 210 has a U-shaped slot 213 (FIG. 1) with an undercut edge for receiving a disk shaped connector 214 of a cartridge adapter 216. The connector 214 has a U-shaped slot with an undercut having a width substantially the same as the diameter of flange 38 at the base of cartridge case 22 (FIG. 11). The overlying flanges on the slot have a width substantially the same as the diameter of cartridge case 22. Hence cartridge case 22 can be held above the priming station, with cartridge flange 38 in the U-shaped slot of connector 214, and primer socket 30 facing the priming station, and aligned above the slot 180 of the advancement member 168.

A plastic bushing 218 (FIG. 2) may be placed in an orifice through connector 214, to establish a close tolerance tubular pathway through which a punch pin 226 can reciprocate. Bushings of varying sizes can be used with push pins of varying diameters to maintain a close tolerance tubular path between punch hole 208 and primer socket 30, such that the primer 24 remains aligned with socket 30.

As shown best in FIGS. 5–7, a pair of flexible detent arms 220, 222 are positioned, one on each longitudinal edge of the track 140. Detent arms 220, 222 are recessed into top surface 143 (for example by a distance of about 0.5 mm) so that the detent arms extend parallel to and in close tolerance to ledges 144, 146. Arms 220, 222 extend at an angle towards each other, progressing in the advancing direction of arrow 172, and are then inclined forwardly, over ledges 144, 146, immediately forward of interrupted track sections **145*a*, 145*b*. Arms 220 and 222 terminate at tips 220*a*, 222*a* respectively, that extend into gaps 156 between teeth 154** (FIG. 7).

Arms 220, 222 are longitudinally offset with respect to strip 148 such that tip **220*a* projects forwardly into a gap 156 that is one tooth rearward of the gap 156 into which tip 222*a* extends. Tips 220*a*, 222*a* engage the laterally extending teeth 154 of the primer strip 148 when the strip is advanced into the priming station. In the disclosed embodiment, arms 220, 222 terminate over ledges 144, 146** (FIGS. 5 and 6). The flexible nature of the arms allows them to move away from the teeth when the strip is advanced.

Head 112 of ram 110 includes a central tubular receptacle 224 (FIGS. 2 and 4) extending along the axis of reciprocation of ram 110, and having a diameter suitable for seating an enlarged head 225 of a straight push pin 226. The diameter of the main body of push pin 226 is slightly less than the diameter of the receptacles 150 in the primer strip 148. The length of push pin 226 is sufficient to insert pin 226 through the receptacle 150 to push a primer out of the receptacle 150 and through bushing 218 into the primer socket 30 of the cartridge case held in adapter 216 during the loading operation. The pin is also sufficiently narrow that it can freely slide through slot 180 of advancement member 168 as the advancement member reciprocates.

The push pin is easily removed from the tubular receptacle 224 in which it seats, so that pins of different diameters can readily be placed in the ram head 112 to be used with primers and primer strip receptacles of varying sizes. The bushings 218 may similarly be replaced to accommodate pins and primers of varying sizes. The diameter of the enlarged head 225 of each pin is uniform, so that any of the pins will fit with close tolerance into the tubular receptacle 224.

A cam lock pin 223 may be inserted through the side member 130 (FIG. 1) to lock the push plate 190 in the retracted position (as shown in FIGS. 4 and 7). Locking push plate 190 in this position allows the ram 110 to be freely reciprocated, for example to place push pin 226 in receptacle 224, to advance strip 148 until hook 160 engages the pin, or to rotate threaded end 115 of ram 110 to adjust the length of the ram. Adjusting the height of the ram allows the pin 226 to advance a desired distance into primer socket 30 to load the primer 24.

In operation, primer strip 148 is placed on track 140 as shown in FIG. 3, with teeth 154 supported on ledges 144, 146 and tubular extensions 158 extending down toward the track. Primers 24 have been preloaded into strip 148 with the anvil side up and bottom face 32 down. Cartridge case 22 (FIG. 2), with empty primer socket 30, is positioned in holder 206 as shown in the drawings, with socket 30 aligned above punch hole 208 and the tubular opening through bushing 218. Prior to advancing strip 148 to the priming station, handle 54 is lowered to extend ram 110 to the position shown in FIG. 7, and cam lock pin 223 is inserted through the sidewall 130 of the priming head to lock the head 112 in extended position with pin 226 projecting up through slot 180.

Strip 148 is then pushed toward the priming station, hook end first, until hook 160 grasps extended pin 226. In this position, the move over re teeth on strip 148 move over rear arms **184*a* and 184*b* of the advancement member. The effective length of ram 110 can be changed by rotating ram end 115 relative to externally threaded tip 114*a*, which adjusts the distance pin 226 will extend into the receptacles of strip 148. Alternatively, pin 66 can be rotated to determine the distance pin 226 will be advanced. Lock pin 223 can then be removed, which allows ram 110 to retract and advancement member 168 to advance as arms 184*a*, 184*b* push the first set of teeth 148 forward. With the ram retracted, detent arm tip 220*a* will extend into the gap 156 between a first and second tooth to prevent movement of strip 148 in retracting direction 172 during subsequent reciprocations of ram 110**.

Operating lever 54 is then moved up and down by an operator to reciprocate ram 110. As lever 54 is forced downwardly, it moves bearing surface 72 of pivot arm 68 against the bottom of shaft 114, to move ram 110 upwardly against the bias of compression spring 118. As ram 110 advances along its axis of reciprocation, the inclined shoulder 120 of the ram head 112 moves against the bearing surface 200 of push plate 190, to force plate 190 in the retracting direction 172, against the bias of spring 202. As ram 110 continues to move upwardly to its fully extended position (shown in FIG. 4), the annular face of head 112 holds plate 190 in the retracted position.

Movement of the push plate in the retracting direction also forces advancement member 168 in the retracting direction, such that rear arms **184*a*, 184*b* move behind the next set of laterally extending teeth on primer strip 148, into the gaps 156 between the second and third set of teeth. Simultaneous with retraction of the advancement member, punch pin 226 advances through slot 180 and into a first target receptacle 150 and toward the primer socket 30 of case 22 that is aligned above the pin 226. The pin 226 pushes the primer 24 from the receptacle 150 through bushing 218 into the empty socket 30 of the cartridge case in the holder 206. The length of slot 180 is sufficient to allow the advancement member 168 to slide without interference from pin 226 as the pin advances through slot 180 toward primer socket 30. FIG. 4 shows the device 40 with the ram 110 fully extended and the pin 226 projecting through a primer strip receptacle 150 and pressing a primer 24 into socket 30**.

The operator will note resistance to further depression of operating lever 54 once the primer 24 has been inserted into the socket 30. Downward force on lever 54 can then be reduced, and the lever will be pivoted back toward the position shown in FIG. 2 by the action of spring 118 around shaft 114. This spring action retracts ram 110 through slot 180 away from socket 30 and allows push plate 190 to be moved back in the advancing direction 170 by spring 202, which in turn moves advancement member 168 in the advancing direction. Advancement of the advancing member exerts force against the teeth 154 which the arms are engaging, to move the strip 148 forward.

The size and location of the teeth 154, gaps 156 and receptacles 150 are such that the arms 184 move the advancing member forward a calibrated distance which indexes the next receptacle into alignment with hole 208 and pin 226, along the axis of reciprocation of ram 110. The cartridge case 22, with the new primer 24 loaded in socket 30, is removed from holder 208, and a new cartridge case with an empty socket 30 is placed in holder 208 with the socket facing the priming station. Subsequent extension of ram 110 transfers the primer from the aligned receptacle into the empty socket 30 of the new case 22.

As the ram is repeatedly reciprocated by operation of lever 54, strip 148 continues to be incrementally moved forward by the indexing mechanism. After several incremental advancements of the strip, both sets of arms 182, 184 on the advancement member are aligned in gaps 156 spaced longitudinally along the strip. Hence both sets of arms can then advance the strip as the advancement member 168 moves in the advancing direction; during movement of the member in the retracting direction, the arms slide underneath the tooth behind each arm, into the succeeding gap.

Strip 148 does not move in the retracting direction 172 when advancement member 168 moves in that direction because detent arms 220, 222 project at an angle toward each other into gaps 156 between teeth 154. The forward angle of the arms prevents retraction of the strip, and holds the strip in a fixed longitudinal location as the advancement member 168 retracts. The arms 220, 222 are sufficiently flexible, however, to bend away from each other as the primer strip 148 advances to allow movement of the primer strip in the direction 170.

When the trailing end of the primer strip approaches the primer station, a subsequent primer strip **148*b* (FIG. 10) can be attached to the strip 148*a* that is already in place in the priming station. The hook 160 of the second strip 148*b* is placed around the tubular extension 158 of strip 148*a* in the priming station, so that advancement of strip 148*a* in the priming station also pulls subsequent strip 148*b* in the advancing direction and eventually into the priming station. Fully unloaded priming strip 148*a* can then be disconnected from strip 148*b*** and reloaded with primers or discarded.

Figure 12:
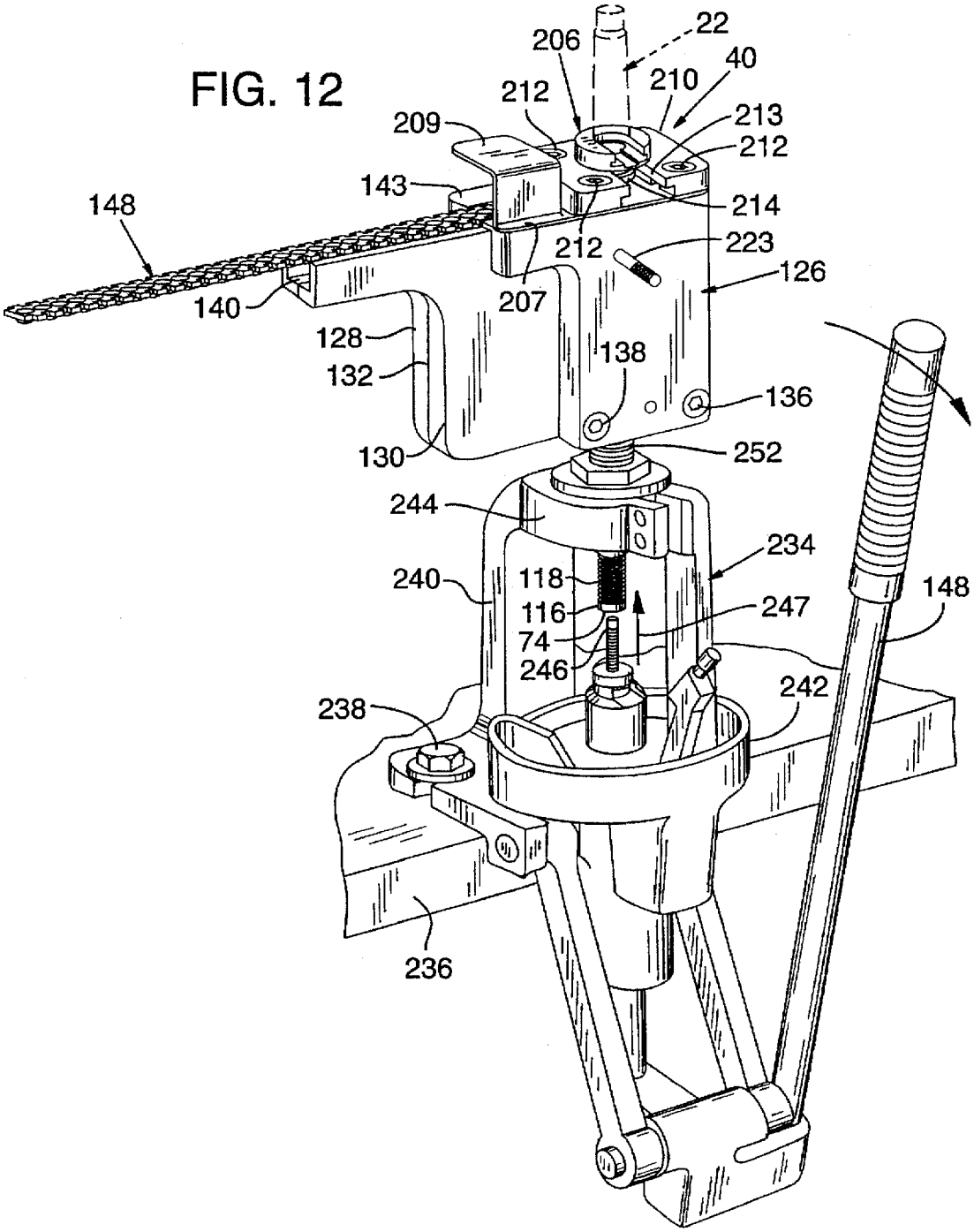
FIG. 12 is a perspective view of another embodiment of the apparatus, which is adapted for attachment to a conventional bench-mounted press.

Another embodiment of the device is shown in FIG. 12, wherein like parts have been given like reference numerals to the embodiment shown in FIGS. 1–11. In the embodiment of FIG. 12, however, the primer head 126 is adapted for attachment to a press 234 which is mounted, for example, on a bench 236 by bolts 238 (only one of which is shown in FIG. 12). The bench mounted press 234 is of a conventional, pre-existing type, for example like that shown in U.S. Pat. No. 4,202,245, or of the kind available from Blount, Inc. Sporting Equipment Division, Lewiston, Ind., under the product designation Rock Chucker Press, item number 09366.

Press 234 has a frame 240 that holds a base member 242 spaced from an internally threaded attachment collar 244. A reciprocal plunger 246 is reciprocated by a pivotally mounted manually operated handle 248 that moves plunger 246 along an axis of reciprocation through the plunger.

Priming head 126 has an externally threaded coupling 252 that is threaded through internally threaded collar 244 so that ram 110 (which is obscured by compression spring 118 in FIG. 12) projects down toward plunger 246.

In operation, operating lever 248 is lowered to advance plunger 246 upwardly, which forces the tip of plunger 246 against the bottom face 74 of ram 110. Ram 110 then moves upward to compress spring 118, retract the advancement member 168, and extend the push pin 226 (not shown in FIG. 12) through a target receptacle of primer strip 148 aligned with the primer socket 30. Extension of the push pin 226 transfers the primer from the target receptacle to the primer socket 30 of case 22 in holder 208. Handle 248 is then moved back to its upright position (shown in FIG. 12) to retract plunger 246, which allows spring 118 to retract ram 110, and retract the push pin to advance the advancement member 168, as described in connection with the embodiment of FIGS. 1–11 above.

The inventive concepts of the present invention are not limited to manual single stage ammunition reloading machines. The device 40 could be automated, for example by providing an automatic cartridge case insertion and retraction device to change the case in the holder 208, so that operation of the device would only require cranking of the operating lever 54. Further automation of the device may even eliminate the cranking step and simply require placing a full primer strip 148 on the track, and the cases would be reloaded by automated operation of the operating lever 54. An advantage of the present device during automated operation is that the primer strips 148 can be made of any length to hold a large number of primers. Alternatively, sequential primer strips can be attached together by hooks 160 to provide a continuous, uninterrupted feed of primer strips to the priming station.

Coded strips 148 of varying size and color can be made to hold primers of different sizes. Color coding of the strips helps assure that primers of the appropriate size are loaded into a corresponding cartridge case having a primer socket of the appropriate size. Use of the strips also avoids the necessity of handling individual primers, and eliminates the necessity of stacking the primers, which can lead to sympathetic explosion of multiple primers during shipping or priming if one of the primers is inadvertently ignited.

The elongated strips 148 also offer several advantages over rotary primer holders, such as the one shown in U.S. Pat. No. 5,198,606. The primer strips of the present invention have less wasted space than a rotary disk because much more of the strip can be used to hold primers; a rotary disk has wasted space at the center of the disk that increases in proportion to the circumference of the disk. The linear advancement of the primer strip of the present invention in a straight path also avoids the necessity of providing structures to convert linear to rotational movement, and allows the priming device to be more compact. The location of the linear strip along the track also provides an indication of the proportion of receptacles that have not yet been unloaded. Such an indication is not provided by a symmetric primer holder disk.

Having illustrated and described the principles of the invention in several preferred embodiments, it should be apparent to those skilled in the art that the invention can be modified in arrangement and detail without departing from such principles. We claim all modifications coming within the spirit and scope of the following claims.

We claim:

1. A tool for inserting a primer into a cartridge case having a primer socket, by transferring the primer from an elongated primer holder strip having a plurality of longitudinally aligned primer receptacles, the tool comprising:

a priming station having a holder that holds the cartridge case with the primer socket in a target position for receiving the primer from a target receptacle of the primer holder strip;

an advancer that incrementally advances the primer holder strip longitudinally through the priming station to sequentially align a series of target receptacles of the primer holder strip with the target position; and a reciprocable punch member for advancing into one of the target receptacles to push one of the primers out of the target receptacle into the target position.

2. The tool of claim 1, further comprising an operating lever which interacts with the punch member as the lever is moved to reciprocate the punch member.

3. The tool of claim 1, wherein the advancer incrementally linearly advances the primer holder strip to sequentially align primers in target receptacles with the target position.

4. The tool of claim 1, wherein the primer holder strip comprises a body having projections which interact with the advancer to incrementally longitudinally advance the primer holder strip.

5. The tool of claim 1, wherein the punch member further interacts with the advancer to incrementally longitudinally advance the primer holder strip.

6. The tool of claim 5, wherein the primer holder strip comprises a body having lateral projections which interact with the advancer to incrementally longitudinally advance the primer holder strip, and the advancer comprises a sliding member in the priming station that reciprocates between an advancing direction and a retracting direction, and the sliding member includes an arm inclined in the advancing direction toward the primer holder strip to engage the lateral projections on the primer holder strip to incrementally advance the primer holder strip as the advancer moves in the advancing direction, and a detent in the priming station that opposes movement of the primer holder strip with the advancer when the advancer moves in the retracting direction.

7. The tool of claim 6, wherein the advancer further comprises a push member extending from the sliding member toward the punch member, wherein the push member has a spring bias to move the sliding member in the advancing direction, and the punch member is positioned to move the push member in the retracting direction against the spring bias as the punch member is moved to the advanced position.

8. The tool of claim 1 further comprising an elongated track comprising elongated substantially parallel supports on which the primer holder strip slides into and through the priming station.

9. A tool for inserting a primer into a cartridge case having a primer socket, by transferring the primer from an elongated primer holder strip having a plurality of longitudinally aligned primer receptacles, the tool comprising:

a priming station for holding the cartridge case with the primer socket in a target position for receiving the primer from a target receptacle of the primer holder strip;

an advancer that advances the primer holder strip longitudinally through the priming station to sequentially align a series of target receptacles of the primer holder strip with the target position; and a punch member for pushing one of the primers out of the target receptacle into the target position;

wherein the punch member comprises a reciprocating member that moves between a retracted position and an advanced position relative to the target receptacle, and a pin is carried by the reciprocating member, wherein the punch member in the advanced position introduces the pin into the target receptacle to push the primer in the target receptacle out of the target receptacle into the primer socket held in the target position.

10. In a device for loading a primer from a priming station to a primer socket of an ammunition cartridge case, the combination of a priming station;

an elongated track through the priming station for longitudinally guiding an elongated primer strip having a plurality of primer containing receptacles;

an indexing mechanism that aligns a target receptacle of the primer strip in a punch location, wherein the indexing mechanism interacts with the primer strip to incrementally advance the primer strip longitudinally along a linear path of movement on the track to sequentially align subsequent target receptacles with a punch member aligned with the punch location; and a connector for connecting the device to a press in which a reciprocable plunger can interact with the punch member to advance and retract the punch member.

11. The device of claim 10, wherein the indexing mechanism includes a sliding member on the track that reciprocates between movement in an advancing direction along the path of movement and movement in a retracting direction opposite the advancing direction, and an arm that projects from the sliding member to engage and advance the primer strip in the advancing direction as the sliding member moves in the advancing direction.

12. The device of claim 11, further comprising a detent positioned to engage the primer strip and allow the primer strip to advance in the advancing direction as the sliding member moves in the advancing direction, but opposes movement of the primer strip in the retracting direction.

13. The device of claim 12, further comprising the primer strip, wherein the primer strip comprises a plurality of longitudinally aligned primer containing receptacles, and wherein the primer strip includes a plurality of lateral projections from a longitudinal edge of the primer strip, and the projections interact with the detent to align the strip in the priming station with one of the target receptacles in the punch location for the primer to be transferred from the target receptacle in the punch location to the primer socket.

14. In a device for loading a primer from a priming station into a primer socket of an ammunition cartridge case, the combination of:

a priming station;

an elongated track through the priming station for longitudinally guiding an elongated primer strip having a plurality of primer containing receptacles; and an indexing mechanism that aligns a target receptacle of the primer strip in a punch location, wherein the indexing mechanism interacts with the primer strip to incrementally advance the primer strip longitudinally along a linear path of movement on the track to sequentially align subsequent target receptacles with the punch location;

wherein the indexing mechanism includes a sliding member on the track that reciprocates between movement in an advancing direction along the path of movement and movement in a retracting direction opposite the advancing direction, and an arm projects from the sliding member to engage and advance the primer strip in the advancing direction as the sliding member moves in the advancing direction;

a detent positioned to engage the primer strip and allow the primer strip to advance in the advancing direction as the sliding member moves in the advancing direction, but opposes movement of the primer strip in the retracting direction; and a reciprocating punch member advanceable into the target receptacle in the punch location to move one of the primers from the target receptacle into the primer socket, and then retractable away from the punch location, wherein advancement of the punch member into the punch location moves the sliding member in the retracting direction, and retraction of the punch member allows the sliding member to move in the advancing direction.

15. The device of claim 14, wherein the sliding member comprises a push member having an inclined surface, and the punch member comprises a bearing surface positioned to interact with the inclined surface of the push member, and the device further comprises a compression member that biases the push member into engagement with the bearing surface of the punch member.

16. The device of claim 15, wherein the bearing surface of the punch member is an annular inclined surface having a slope complementary to a slope of the inclined surface of the push member, and the compression member is a compression spring that biases the push member against the inclined surface when the punch member is in a retracted position, and the punch member moves the push member against the bias of the compression spring as the punch member is advanced, to move the sliding member in the retracting direction.

17. The device of claim 14 further comprising an operating lever that interacts with the punch member to advance and retract the punch member toward and away from the punch location.

18. The device of claim 14, wherein the punch member further comprises a punch pin that advances and retracts with the punch member, and the punch pin is positioned to move through the target receptacle into the primer socket when the punch member is advanced.

19. The device of claim 18 wherein the primer strip comprises a plurality of primer containing receptacles aligned in a straight linear path, and the punch pin is positioned to advance and retract through the target receptacle in the priming station.

20. The device of claim 14, further comprising a holder for holding the cartridge case in a position with the primer socket of the cartridge case in a loading position, and an elongated slot between the holder and the punch member through which a punch pin can be introduced as the sliding member reciprocates on the track.

21. A primer device for pressing a primer into a socket of an ammunition cartridge case, wherein the device comprises:

a priming station comprising a holder for holding the cartridge case in a loading position with a primer socket of the cartridge case facing the priming station;

an elongated rectilinear track through the priming station for guiding an elongated rectilinear primer strip having a plurality of longitudinally aligned primer containing receptacles;

a reciprocating punch member advanceable toward the priming station to introduce a punch pin through the primer station into the primer socket, and retractable away from the priming station to retract the punch pin away from the primer socket, wherein the punch member includes an inclined surface;

an indexing mechanism that advances the primer strip longitudinally along a path of movement on the track after loading one of the primers from the priming station into the cartridge case, to move an unloaded receptacle out of the priming station and move a loaded receptacle into the priming station, wherein the indexing mechanism includes a sliding member on the track that reciprocates between an advancing direction along the path of movement and a retracting direction opposite the advancing direction, and an arm that projects from the sliding member to advance the primer strip in the advancing direction as the sliding member moves in the advancing direction; and a detent positioned to interact with the primer strip and allow the primer strip to move as the sliding member moves in the advancing direction, but opposes movement of the primer strip as the sliding member moves in the retracting direction.

22. The device of claim 21 further comprising a blast shield extending over the track adjacent the priming station.

23. The device of claim 21, further comprising a lock pin that selectively holds the sliding member in a retracted direction such that the punch member is freely advanceable toward the primary station.

24. The device of claim 21, further comprising a removable bushing extending between the socket of the cartridge case and the primer strip to guide a primer strip from the primer strip to the socket.

25. A primer device for pressing a primer into a primer socket of an ammunition cartridge case, wherein the device comprises:

a track having a pair of opposing support ledges;

an elongated primer strip having a plurality of primer containing receptacles, and lateral projections from at least one longitudinal edge of the primer strip which support the primer strip on at least one of the opposing support ledges;

a priming station comprising a holder for holding the cartridge case with the primer socket in a loading position;

a punch member comprising a plunger having a punch pin that is advanceable through one of the receptacles into the primer socket when the primer socket is in the loading position;

a sliding member supported below the track, wherein the sliding member reciprocally moves in an advancing direction and a retracting direction along the track, and an arm from the sliding member extends toward the primer strip to engage the lateral projections and advance the primer strip in the advancing direction along the track when the sliding member moves in the advancing direction;

a detent having an arm that projects toward the advancing direction to engage the lateral projections from the primer strip and oppose movement of the primer strip in a direction opposite the advancing direction when the sliding member moves in the retracting direction;

a plunger that reciprocates between a retracted position in which it does not interfere with movement of the primer strip, and an advanced position in which a primer pin extends through one of the receptacles of the primer strip and into the primer socket to load the primer into the socket; and an advancement member extending from the sliding member toward the plunger, wherein the advancement member has a spring bias to move the sliding member in the advancing direction, and the plunger moves the advancement member against the spring bias as the plunger moves to the advanced position, to move the sliding member in the retracting direction.

26. The device of claim 25, further comprising a manual operation lever for moving the plunger between the retracted position and the advanced position.

27. The device of claim 26, further comprising an adjustable stop that limits a pivoting motion of the manual operation lever to selectively set a forward limit to which the reciprocating punch member is advanceable.

28. The device of claim 26 wherein the manual operation lever comprises a pivot arm pivotally mounted to the primer device, and a pivot arm head to which a handle bar member is pivotally attached at a pivot connection, further comprising fixation members that selectively fix the pivotal handle bar member extending at a selected angle relative to the pivot arm head.

29. A primer device for pressing a primer into a primer socket of an ammunition cartridge case, wherein the device comprises:

track means for supporting an elongated primer strip having a plurality of longitudinally arranged primer containing receptacles;

holding means for holding the cartridge case with the primer socket facing the track means;

alignment means for aligning a target receptacle of the primer strip with the primer socket in the cartridge case held by the holding means;

punch means for advancing into one of the target receptacles aligned with the primer socket to push a primer out of the target receptacle and into the primer socket; and advancement means for advancing the primer strip in a linear advancing direction longitudinally along the track after the punch means has punched the primer out of the target receptacle.

30. The primer device of claim 29, further comprising detent means for opposing movement of the primer strip opposite the path of advancement.

31. The primer of claim 30, wherein the advancement means comprises a sliding member on the track with arm means for engaging the lateral projections of the primer strip when the advancement means moves in the linear advancing direction, to advance the primer strip.

32. The primer device of claim 29, further comprising manual operating lever means for moving the punch means between an advanced position in which the punch means extends through the target receptacle of the primer strip, and a retracted position in which the punch means does not interfere with movement of the primer strip.

33. A device for loading a primer into a primer socket of an ammunition cartridge case, comprising:

a linearly extending elongated track presenting a pair of opposing parallel ledges for supporting a rectilinear primer strip having a plurality of primer containing receptacles and a plurality of laterally extending projections;

an advancement member that reciprocally slides along the track in an advancing direction and an opposite retracting direction, along a path spaced from the opposing ledges, wherein the advancement member includes an elongated slot and a pair of parallel advancement arms that are inclined in the advancing direction, wherein the advancement arms extend beyond one of the ledges, for engaging and advancing the laterally extending projections of the primer strip when the advancement member moves in the advancing direction, and the advancement member further comprises a push plate that extends perpendicularly away from the track and has a spring bias to move the advancement member in the advancing direction, wherein an edge of the push plate forms an inclined edge;

a holder that forms a cartridge case slot that accepts a cartridge case flange to hold the cartridge case with the primer socket facing the elongated slot in the advancement member;

a pair of detent arms, one positioned along each longitudinal edge of the track adjacent one of the ledges, wherein the detent arms are angled towards each other, and each arm extends at least as far as the adjacent ledge, to engage the laterally extending projections of the punch strip;

a ram that reciprocates perpendicular to the track between an advanced position and a retracted position, and is spring biased into the retracted position, wherein the ram includes a head having an annular inclined shoulder that seats against the inclined edge of the push plate when the ram is in the retracted position, wherein an axis of advancement of the ram intersects the slot in the advancement member, and the width of the head of the ram is sufficient to push the push plate against the spring bias of the push plate and move the advancement member in the retracting direction; and a push pin carried by the head of the ram and extending in the axis of advancement of the ram, the push pin being of sufficient length to extend through the slot in the advancement member when the ram is in the extended position, and through a target receptacle in the primer strip, to push the primer out of the target receptacle and into the primer socket.

34. The device of claim 33, further comprising a hand operated lever that abuts the ram and moves the ram between its advanced and retracted positions.

35. A method of inserting a primer into an ammunition cartridge case having a primer socket, comprising the steps of:

providing an elongated primer holder strip comprising a plurality of longitudinally aligned primer containing receptacles;

holding the cartridge case with the primer socket in a loading position;

positioning the primer holder strip with a first receptacle in a target position;

advancing a punch pin through the first receptacle in the target position to transfer the primer in the first receptacle into the primer socket; and advancing the primer holder strip longitudinally along a track to align a subsequent receptacle in the target position.

36. The method of claim 35, wherein the step of providing the primer holder strip comprises providing a series of equally spaced lateral projections along opposing longitudinal edges of the strip, and the step of advancing the primer holder strip comprises providing an advancement member with a pair of arms that interdigitate with the lateral projections, and moving the advancement member in an advancing direction in a plane parallel to the primer holder strip to advance the primer holder strip and align the subsequent receptacle in the target position.

37. The method of claim 36, wherein the step of advancing the primer holder strip comprises moving a hand operated lever to move the advancement member in the advancing direction, then moving the lever to move the advancement member in a retracting direction opposite the advancing direction, without moving the primer holder strip in the retracting direction.

38. A tool for inserting a primer into a cartridge case having a primer socket, by transferring the primer from an elongated primer holder strip having a plurality of longitudinally aligned primer receptacles, the tool comprising:

a priming station;

an advancer that incrementally advances the primer holder strip longitudinally through the priming station to sequentially align a series of target receptacles of the primer holder strip with a target position; and a reciprocable punch member that advances into one of the target receptacles aligned with the target position to push one of the primers out of the target receptacle into the primer socket.

39. The tool of claim 38, wherein the advancer incrementally advances the holder strip by interacting with a plurality of extensions extending laterally from the primer holder strip.

* * * * *